United States Patent [19]

Reinhall et al.

[11] Patent Number: 4,600,475

[45] Date of Patent: Jul. 15, 1986

[54] REFINING APPARATUS WITH RADIAL PASSAGEWAYS FOR STEAM RECOVERY

[75] Inventors: Rolf B. Reinhall; Johan G. I. Johansson, both of Bellevue, Wash.

[73] Assignee: Sunds Defibrator Aktiebolag, Sundsvall, Sweden

[21] Appl. No.: 679,044

[22] PCT Filed: Feb. 17, 1984

[86] PCT No.: PCT/SE84/00057

§ 371 Date: Nov. 7, 1984

§ 102(e) Date: Nov. 7, 1984

[87] PCT Pub. No.: WO84/03526

PCT Pub. Date: Sep. 13, 1984

[30] Foreign Application Priority Data

Mar. 9, 1983 [SE] Sweden ..... 8301271

[51] Int. Cl.[4] ..... D21C 1/12; D21D 1/30

[52] U.S. Cl. ..... 162/261; 162/23; 241/244

[58] Field of Search ..... 162/261, 28, 23; 241/244, 28, 245

[56] References Cited

U.S. PATENT DOCUMENTS

| | | | |
|---|---|---|---|
| 4,082,233 | 4/1978 | Reinhall | 162/28 |
| 4,221,343 | 9/1980 | Skeen | 241/244 |
| 4,235,665 | 11/1980 | Reinhall et al. | 162/261 |
| 4,326,913 | 4/1982 | Mattson | 241/28 |
| 4,378,092 | 3/1983 | Reinhall | 241/28 |

*Primary Examiner*—Steve Alvo

*Attorney, Agent, or Firm*—Burns, Doane, Swecker & Mathis

[57] ABSTRACT

A refiner for manufacturing fibre pulp from lignocellulose-containing material, comprising a pressure-proof refiner housing (20) with opposed refining members (21,22) rotating relative to each other. Steam is separated from the fibre pulp in the refiner housing (20) at the counter-effect of a fibre separating rotor (30) provided with wing members (31) and located on the rear side of a rotatable refining member (22). The steam is thereafter compressed in at least one step by means of this rotor (30) and possibly subsequent turbine wheels (34).

7 Claims, 1 Drawing Figure

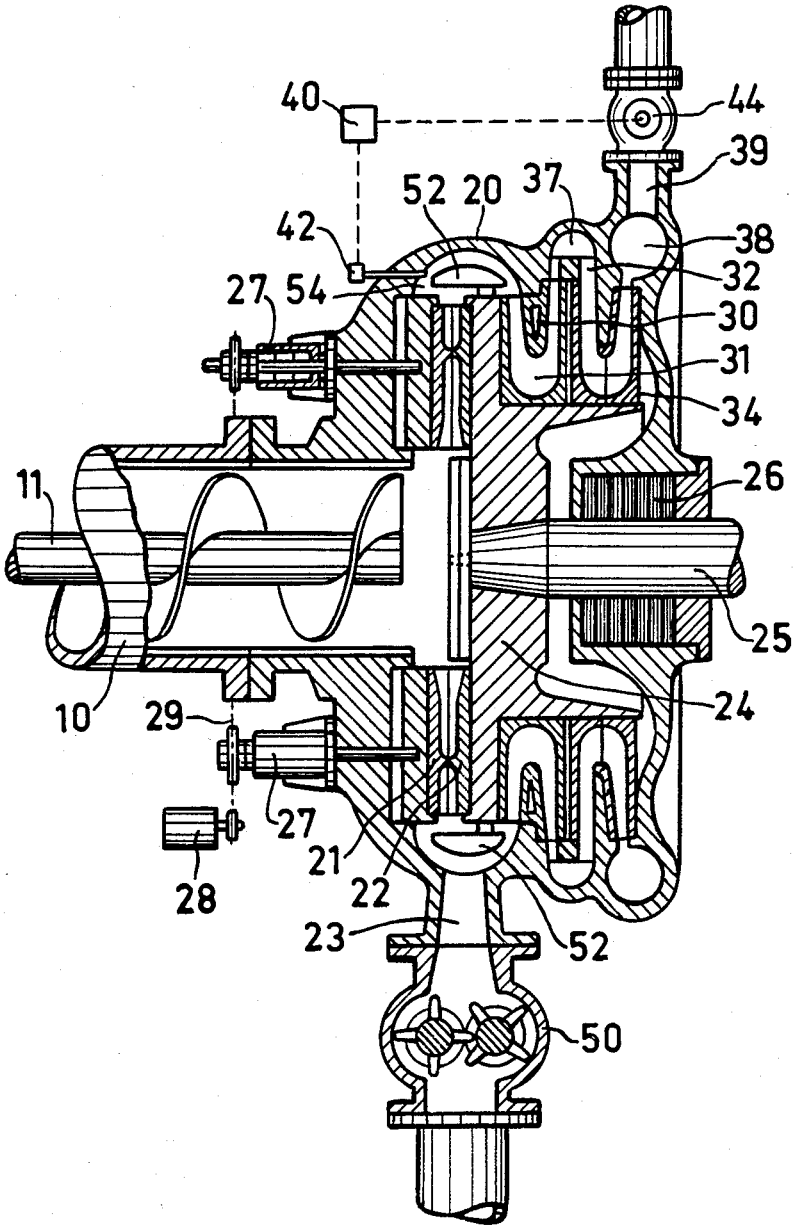
40
44
39
52
20
37
42
38
32
27
54
30
31
34
11
26
25
10
29
24
27
21
22
28
23
52
50

REFINING APPARATUS WITH RADIAL PASSAGEWAYS FOR STEAM RECOVERY

This invention relates to a method and an apparatus for entirely or partially recovering supplied heat and electric energy during the manufacture of fibre pulp from lignocellulose-containing material, such as chips from softwood or hardwood, bamboo, straw, bagasse etc. The invention comprises mechanical disintegration of chemically processed or unprocessed material at increased temperature to fibre state in a refiner. The refiner comprrises at least two opposed refining members rotable relative to each other and enclosed in a pressure-proof refiner housing and having refining surfaces, which are plane, conic, spherical or a combination thereof. The opposed refining members, thus, can be rotatable in opposite directions or one member may be rotatable and the other one stationary.

The mechanical disintegration of the material is effected in that the material is supplied to the inlet opening of the refining members and successively discharged from there through an adjustable gap maintained between the refining members.

This disintegration or refining of the material requires, depending on the type of fibre pulp manufactured, a varying amount of electric and steam energy (50–3500 kWh/ton), usually at a processing temperature of 100°–250° C.

The fibre pulp manufactured at the disintegration and the steam generated or supplied can be separated, according to a method described previously in Swedish patent application No. 8300961-3, while in the refiner housing operating under pressure, where fibre pulp and steam separately are discharged from the refiner individually.

The separation of steam and fibres is effected in that steam generated during the process or supplied is forced by the steam pressure generated during the process to pass from the space outside the periphery of the refining members against the effect of the centrifugal force inward on the rear side of a rotatable refining member. This refining member, therefore, is provided with wing members preventing the fibre pulp from flowing inward.

During this passage through the wing members the steam amount going off from the process and the fibres thereby suspended and following along are caused to assume a rotation speed corresponding to that of the refining member and thereby are subjected to a centrifugating cleaning. By the effect of the centrifugal force the fibres and particles following along with the steam are returned to the fibre outlet of the refiner, and at the same time the cleaned steam is discharged separately from the refiner housing for further use.

The steam thus discharged, by being fed in radial direction to the rotation center against the effect of the centrifugal force, is subjected to a small pressure reduction. Therefore, a sealing device is required to prevent fiber passage between the periphery of the wing members and the space outside said members where the cleaned steam is collected for being discharged.

This sealing requirement is eliminated according to the invention, at the same time as the high rotation speed of the refining member is utilized for bringing about by one or several compression steps an increase in the pressure of the discharged steam. The present invention, thus, renders it possible that the steam amount discharged from the process is transferred to a higher energy level by means of turbine wheels in connection to the rotor or axle of the refiner. The pressure can be increased to a level, which renders it possible to use the steam for more qualified application fields, papermaking machines, drying plants etc. Such installations usually require a steam pressure higher than normally permissible at the fibre manufacturing process.

BRIEF DESCRIPTION OF THE DRAWING

The FIGURE is a schematic section of a refiner applicable in the process and provided with a fibre separating rotor and with steam pressure increasing turbine wheels directly connected to the refiner.

The refiner shown in the FIGURE comprises a pressure-proof refiner housing 20 and a feed-in conveyor 10 with a conveyor screw 11 for feeding the material to refining members 21 and 22 enclosed in the refiner housing 20. In the embodiment shown, the refining member 21 is stationary with respect to rotation, but axially movable for adjusting the distance between the refining members. This adjustment is effected by adjusting means 27, which are controlled simultaneously by a control member 28 via a drive chain 29 surrounding all adjusting means 27.

The refining member 22 is rotary and connected to a rotor 24.

The rotor 24 is supported on an axially fixed drive axle 25, which is sealed by a sealing device 26 at the entrance in the refiner housing 20 operating under pressure.

The material processed in the refiner is collected in the space 54 in the refiner housing 20 outside the refining members together with generated or supplied steam. The processed refiner produce is transferred by one or several dogs 52 connected circumferentially to the rotor 24 through an opening 23 in the refiner housing 20 to a pressure-proof connected discharge device 50, which does not permit steam passage. The fibre pulp thereby is discharged without or only with a small amount of steam following along.

The rotor is provided on its rear side with a fiber-separating rotor 30 comprising wing members or blades 31, which between themselves form passageways extending first substantially radially inward and thereafter substantially radially outward to an annular space 37. The passageways preferably open into the space 37 on a greater diameter than the inlet from the space 54.

The steam amount generated during or supplied to the process is forced by the steam pressure generated in the process in the space 54 to flow in radial direction inward to the rotation center through the separating rotor 30, where the steam and fibers and particles following along are caused to assume a rotation speed corresponding to that of the refining member 22 and there are subjected to a centrifugating cleaning. By means of the centrifugal force generated in the rotation, the fibers and solid particles are returned to the space 54 outside the refining members 21,22 while the cleaned steam is transferred to said annular space 37.

In the embodiment shown, a second annular space 38 is located after the first annular space 37. These spaces intercommunicate through stationary guide bars 32, which are capable of passing the steam inward from the first space 37, and a turbine wheel 34 rotating together with the refining member 22, which turbine wheel is capable to pass the steam with increased pressure outward to the second space 38.

The steam pressure in the annular space 37 at the outlet of the steam from separating rotor 30 with its greater diameter and efficiently designed wing members 31 is higher than the steam pressure in the space 54. This eliminates the risk of leakage of fiber fragments and other solid particles from the refiner housing 20 to the space 37 for the cleaned steam.

The compressed steam leaving the turbine wheel 34 is collected in the second annular space 38. The steam is discharged from there through an outlet 39 and a control valve 44 located there, by which valve the pressure in the refiner is controlled. In the embodiment shown this control is effected by means of a pressure sensing member 42 and an adjusting member 40, which controls the valve 44, so that the desired pressure can be maintained in the space 54 outside the refining members 21,22.

The invention can be varied within wide limits, with respect of number, diameters and type of compression steps. The pressure increasing part, thus, can be separated from the refining member 22 and fiber separating rotor 30 there attached and be placed in a space separated from the refiner housing, driven directly or indirectly from the axle 25 carrying the refining member 22.

The pressure increasing turbine also can be provided with intake for steam drained at other places in the process, for example at the inlet to the refining members.

The pressure increasing means also can be divided into different groups of turbine wheels with a different number of steps for increasing the pressure of steam from different take-offs with different pressure to a common higher level.

The invention is not restricted, either, to the embodiments set forth, but can be varied additionally within the scope of the invention idea.

We claim:

1. An apparatus for entirely or partially recovering steam which is generated in a process for manufacturing fiber pulp from lignocellulose-containing material, comprising at least two opposed refining members rotatable relative to each other about an axis and enclosed in a pressure-proof refiner housing, the refining members between themselves form at least one gap in which the lignocellulose-containing material is intended to be disintegrated to fiber pulp, wherein a rotor is axially spaced from the refining members and rotatable with one of the refining members, wing members being provided on the rotor and rotatable together with said one of the refining members, a first space provided in the housing and located radially outwardly from the refining members, the wing members defining passageways between each other which extend in a first direction substantially radially inward and thereafter in a second direction substantially radially outward to an annular space in communication with an outlet for the steam, said passageways connect the first space to said annular space.

2. An apparatus as defined in claim 1, wherein the passageways between the wing members open into the annular space and the first space, the annular space being located radially outwardly from the first space.

3. An apparatus as defined in claim 2, wherein at least one additional annular space is axially spaced from the annular space, said at least one additional annular space and the annular space being in communication, stationary guide bars positioned between said at least one additional annular space and the annular space so as to direct the steam from the annular space to said at least one additional annular space, and a turbine wheel rotatable together with the rotatable refining member, so as to increase the pressure of the steam.

4. An apparatus as defined in claim 2, wherein control means are provided for adjusting pressure of the steam in the refiner housing by a pressure sensing member in the refiner housing and a valve in the steam outlet.

5. An apparatus as defined in claim 1, wherein at least one additional annular space is axially spaced from the annular space, said at least one additional annular space and the annular space being in communication, stationary guide bars positioned between said at least one additional annular space and the annular space so as to direct the steam from the annular space to said at least one additional annular space, and a turbine wheel rotatable together with the rotatable refining member so as to increase the pressure of the steam.

6. An apparatus as defined in claim 5, wherein control means are provided for adjusting pressure of the steam in the refiner housing by a pressure sensing member in the refiner housing and a valve in the steam outlet.

7. An apparatus as defined in claim 3, wherein control means are provided for adjusting pressure of the steam in the refiner housing by a pressure sensing member in the refiner housing and a valve in the steam outlet.

* * * * *